United States Patent [19]

Yie

[11] Patent Number: 4,768,709

[45] Date of Patent: Sep. 6, 1988

[54] PROCESS AND APPARATUS FOR GENERATING PARTICULATE CONTAINING FLUID JETS

[75] Inventor: Gene G. Yie, Auburn, Wash.

[73] Assignee: Fluidyne Corporation, Auburn, Wash.

[21] Appl. No.: 925,691

[22] Filed: Oct. 29, 1986

[51] Int. Cl.[4] ..... B24C 5/04; B05B 7/14

[52] U.S. Cl. ..... 239/8; 239/336; 239/412; 51/438; 51/439; 175/67

[58] Field of Search ..... 175/67, 393, 424; 166/298; 299/17; 239/407, 412, 433, 434, 9, 336, 8; 137/14, 895; 251/4, 5, 7; 51/438, 439

[56] References Cited

U.S. PATENT DOCUMENTS

| | | | |
|---|---|---|---|
| 1,914,851 | 6/1933 | Fyfe | 251/4 |
| 2,305,840 | 12/1942 | Brown et al. | 51/439 X |
| 2,691,087 | 6/1953 | Greiser | 51/438 |
| 2,810,396 | 10/1957 | Sterrett | 137/416 |
| 3,102,368 | 9/1963 | Smith | 51/438 |
| 3,416,614 | 12/1968 | Goodwin et al. | 175/67 |
| 3,424,386 | 1/1969 | Maasberg et al. | 239/427.3 |
| 3,550,861 | 12/1970 | Teson | 239/546 |
| 3,759,483 | 9/1973 | Baxter | 251/7 X |
| 3,838,742 | 10/1974 | Juokum-Wold | 175/424 X |
| 3,972,150 | 8/1976 | Hart | 51/428 |
| 3,994,097 | 11/1976 | Lamb | 51/11 |
| 4,080,762 | 3/1978 | Watson | 51/439 |
| 4,125,969 | 11/1978 | Easton | 51/320 |
| 4,449,332 | 5/1984 | Griffiths | 51/439 |
| 4,478,368 | 10/1984 | Yie | 239/430 |
| 4,518,145 | 5/1985 | Keltz | 251/7 X |
| 4,534,427 | 8/1985 | Wang et al. | 175/424 X |
| 4,548,382 | 10/1985 | Otting | 251/7 X |
| 4,666,083 | 5/1987 | Yie | 51/439 X |

FOREIGN PATENT DOCUMENTS

| | | | |
|---|---|---|---|
| 119338 | 9/1984 | European Pat. Off. | 299/17 |

OTHER PUBLICATIONS

Gene G. Yie, "Cutting Hard Rock with Abrasive-Entrained Waterjet at Moderate Pressures", paper presented at 2d U.S. Waterjet Symposium, Rolla, Mo., May 26, 1983.

*Primary Examiner*—Andres Kashnikow
*Assistant Examiner*—Kevin P. Weldon
*Attorney, Agent, or Firm*—Thomas W. Speckman; Ann W. Speckman

[57] ABSTRACT

A process and apparatus for generating high velocity particulate containing fluid jets is provided which is capable of cutting hard materials such as rock and concrete, and is especially useful for notching blast holes to control the pattern of explosion and material removal. A particulate passage valve is provided to open and close the particulate passage in response to changes in fluid pressure. The apparatus may be portable, durable and lightweight. The nozzle assembly may be inserted directly into the drill hole and is operable in any orientation to issue one or a plurality of particulate containing fluid jet streams.

18 Claims, 2 Drawing Sheets

Fig. 6.
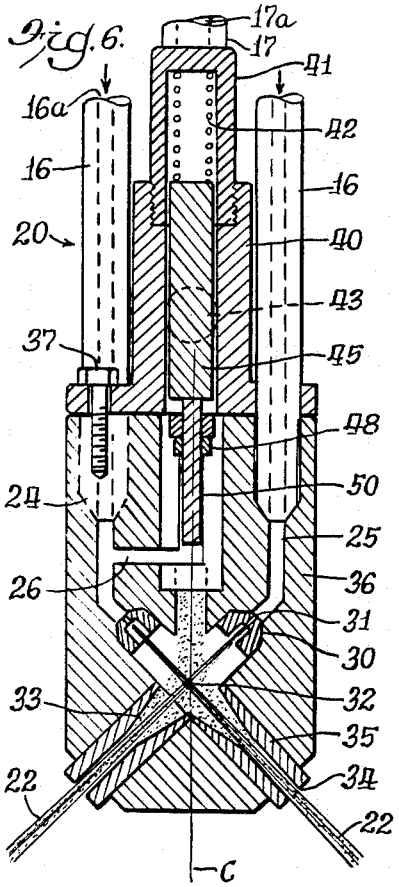
Fig. 7.
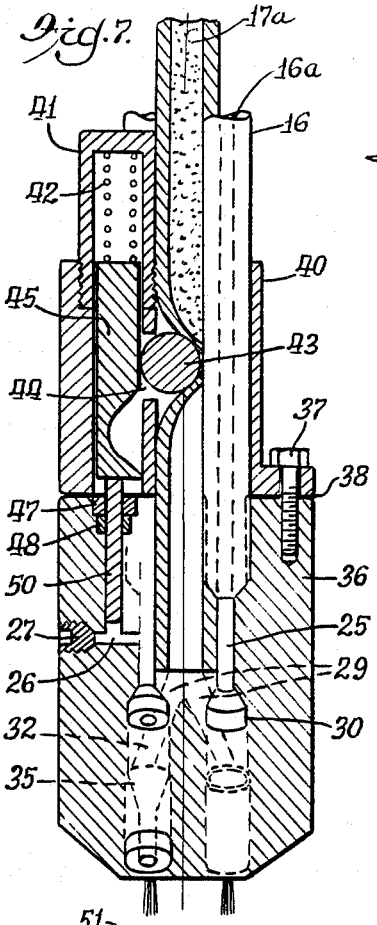
Fig. 11.
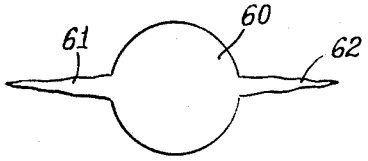
Fig. 12.
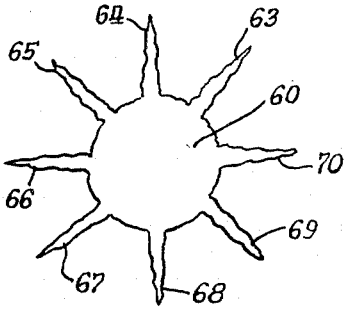
Fig. 8.
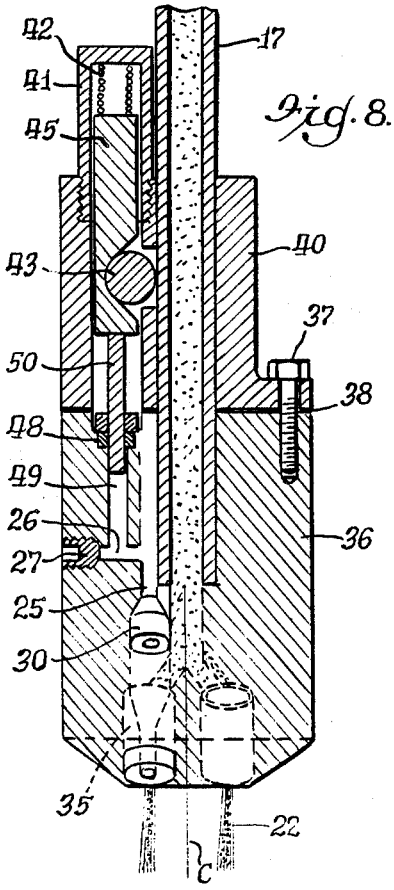
Fig. 9.
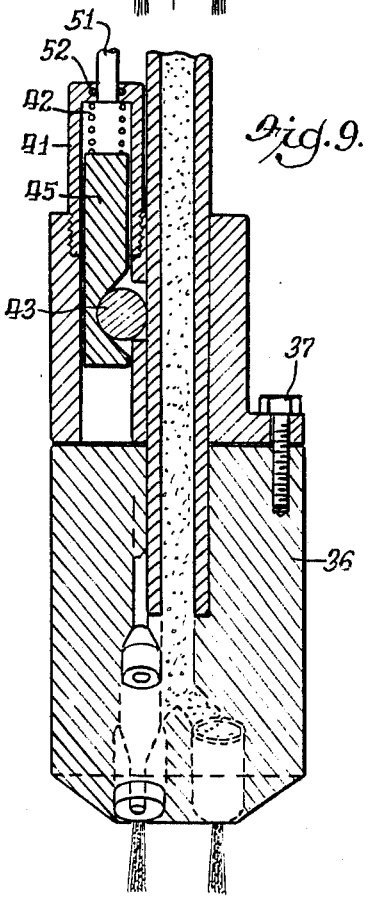
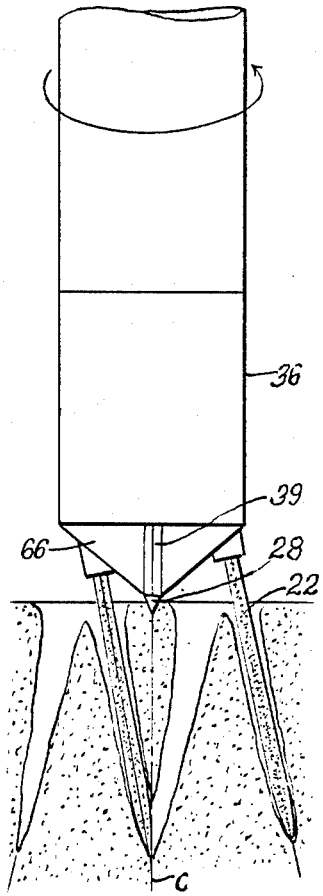
Fig. 10.

PROCESS AND APPARATUS FOR GENERATING PARTICULATE CONTAINING FLUID JETS

BACKGROUND OF THE INVENTION

1. Field of the Invention

This invention relates to a process and apparatus for generating high velocity particulate containing fluid jets which are suitable for making notches in blast holes to control fracture formation during the detonation of explosives.

2. Description of the Prior Art

Blasting with explosives is utilized in mining, tunneling, excavation, demolishing operations, and the like, to remove hard, generally impenetrable materials such as ice, rock, minerals, concrete, and the like. In blasting operations, blast holes are drilled into the hard material, generally with a percussive tool or a drill, and the holes are filled with explosives. If a large volume of material is to be removed, a series of blast holes must be drilled in a prescribed pattern to control the pattern of explosion and material removal. Proper spacing and arrangement of blast holes depends upon the properties of the hard material being removed and the amount and type of explosives used.

It is highly desirable to control fracture formation during detonation of explosives so as to control the explosion and removal pattern by linking the blast holes. One common method of controlling fracture formation is to make wedge-shaped notches along a blast hole in the direction of the desired fracture formation. Notching blast holes in hard materials, such as rock, minerals and concrete is, however, very difficult. Carbide or diamond studded cutting wheel tools, saws, and drills have been devised for notching blast holes, but these tools have recognized limitations, such as rapid wear of cutting edges, expense to manufacture and operate, slow, noisy, dusty and fatiguing operation, and excessive fragility for use in most blasting environments.

High velocity water jets generated at pressures of up to 60,000 psi are used industrially to cut various materials, such as paper products, leather, polymers, plastics, textiles and asbestos products. Utilization of high velocity water jets for cutting operations is gaining popularity because of its many inherent advantages, including absence of tool contact and wear, heat and dust generation, and high speed and quality of cuts. U.S. Pat. No. 4,478,368, which is incorporated herein by reference in its entirety, describes high pressure water jet apparatus, applications and technology. Since high velocity water jets can be generated utilizing relatively small nozzles, the water jet apparatus can be inserted directly into a blast hole for notching the rock. In general, however, the application of high velocity water jets to cut hard materials such as rock and concrete has been unsatisfactory, since the water jets tend to cause spalling and fracturing of hard materials, rather than cutting the material cleanly.

Abrasive particles propelled by compressed air have been used to cut many hard materials. This method can be quite effective when the abrasive particles are accelerated to high velocity and ejected through a suitable nozzle. However, the difficulty in containing the particles and dust during cutting operations prohibits its use in large scale material cutting. Currently, air-propelled abrasive powders are used for deburring metals and for surface preparation of materials where a hood or an enclosure can be employed to contain the dust. A wide variety of abrasive powders, such as silicon carbide, aluminum oxide, garnet, glass beads and silica sand are used for such applications.

The combination of solid particulates with a high pressure fluid jet has been utilized for several purposes. For example, U.S. Pat. No. 2,810,396 teaches solid particles in an air or steam injector as an attrition impact pulverizer; U.S. Pat. No. 3,424,386 teaches mixing of granular solids with a liquid for use in sandblasting; U.S. Pat. Nos. 3,972,150 and 3,994,097 teach water jets having particulate abrasives for cleaning with water pressures under 5000 psi; U.S. Pat. No. 4,080,762 teaches a fluid and abrasive jet for paint removal with fluid pressures up to 30,000 psi; and U.S. Pat. No. 4,125,969 teaches a wet abrasion blast cleaning apparatus and method utilizing soluble abrasive materials. U.S. Pat. No. 4,449,332 teaches a nozzle holder for dispensing a water jet containing particulate abrasive material which may be used for cutting or cleaning applications. The nozzle assembly is capable of withstanding high liquid pressures of between about 10,000 to about 50,000 psi.

U.S. Pat. No. 4,478,368 teaches a high velocity particulate containing fluid jet apparatus and process providing improved fluid jet quality by utilizing multiple fluid jets and flow shaping construction. This patent also teaches the supply of solid particulates in a foam for mixture with the fluid jet stream to minimize energy loss of the fluid jet stream and provide better control of the introduction of solid particulates into the fluid stream. Very hard materials, such as concrete, rock, glass and metals, may be cut using fluid jets containing abrasive particulates which have been generated at moderate fluid pressures and at high fluid pressures of up to 60,000 psi. Gene G. Yie, "Cutting Hard Rock with Abrasive-Entrained Waterjet at Moderate Pressures", paper presented at 2d U.S. WaterJet Symposium, Rolla, Mo., May 26, 1983, for example, described that glass can be cut into complicated shapes with abrasive fluid jets when very hard abrasives, such as garnets, are used. Fluid jets containing abrasive particulates may be utilized to make many different types of cuts. The kerf produced by a suitable abrasive water jet nozzle may be as narrow as less than 0.05 inch or as wide as more than 1.0 inch.

In these types of particulate containing fluid jet generators, the factor which determines the cutting capabilities of the abrasive fluid jet is the efficiency of the nozzle assembly in accelerating the particulates in the fluid jet for cutting applications. It is desirable that the velocity of the abrasive fluid jet as it exits the nozzle is as high as possible, and that all particulates introduced be accelerated to a very high speed. It is preferred, in these types of abrasive fluid jet generators, that all fluid and particulate chamber walls have smooth surfaces to minimize fluid turbulence. Mixing of abrasive particulates into a highly pressurized, coherent fluid jet is very difficult to achieve.

SUMMARY OF THE INVENTION

It is an object of the present invention to provide a process and apparatus for generating high velocity particulate containing fluid jet streams capable of cutting very hard materials such as ice, concrete, rock and minerals.

It is another object of the present invention to provide a high velocity particulate containing fluid jet apparatus which may be inserted into a blast hole and activated to generate one or more particulate containing fluid jet streams for making notches in a blast hole.

It is yet another object of the present invention to provide a process and apparatus for generating particulate containing fluid jet streams incorporating a particulate passage valve means which permits the free flow of particulates during operation of the apparatus, and closes the particulate passage at the nozzle assembly when the apparatus is not operating.

It is yet another object of the present invention to provide a particulate passage valve means at the nozzle assembly which responds to changes in fluid pressure to open and close the particulate passage in a high velocity particulate containing fluid jet apparatus and process.

It is yet another object of the present invention to provide a blast hole drilling and notching means utilizing high velocity particulate containing fluid jet streams which is portable, durable and lightweight, and is operable in horizontal, vertical, and inclined positions.

It is yet another object of the present invention to provide a blast hole notching means utilizing high velocity particulate containing fluid jet streams to control fracture initiation in blast holes for use in numerous geotechnical applications, such as mining, tunneling, demolishing, trenching, excavation, construction, and the like.

According to the process and apparatus of the present invention, pressurized fluid is delivered to a nozzle assembly separately from particulates, and particulates are introduced into one or a plurality of pressurized fluid streams to generate one or more high velocity particulate containing fluid jet streams. The one or more particulate containing fluid jet streams may be oriented parallel to one another, or they may be diverging or converging with respect to the central axis of the nozzle assembly, as is known to the art. The apparatus of the present invention may be sized for insertion directly into blast holes for making notches therein and, in a preferred embodiment, is provided with a particulate passage valve means which operates to close and seal the particulate passage when the fluid jet apparatus is not in operation and open the particulate passage as soon as fluid jets are generated. In another preferred embodiment, the valve means operates in response to changes in fluid pressure of the pressurized fluid supplied. According to yet another preferred embodiment, one or more high velocity particulate containing fluid streams cooperates with a drill tip provided on the nozzle assembly to provide an apparatus capable of drilling holes in hard materials such as rock. Blast holes in very hard rock having a compressive strength in excess of 20,000 psi can be notched to a considerable depth utilizing particulate containing fluid jet streams generated by moderate fluid pressures of about 10,000 psi according to the process and apparatus of the present invention.

BRIEF DESCRIPTION OF THE DRAWINGS

Specific embodiments of the apparatus of the present invention are shown in the drawings, wherein:

FIG. 6 shows an enlarged partially cross-sectional view of a nozzle assembly suitable for generating a plurality of diverging particulate containing fluid jet streams;

FIG. 7 shows an enlarged partially cross-sectional view of a nozzle assembly with a particulate passage valve means in closed condition to seal the particulate passage when the apparatus is not operating;

FIG. 8 shows the nozzle assembly of FIG. 7 with the particulate passage valve means in open condition due to high fluid pressure to provide particulate supply for generating a plurality of high velocity particulate containing fluid jets;

FIG. 9 shows a nozzle assembly similar to that shown in FIG. 8, in which the particulate passage valve means is activated manually or mechanically by a valve stem means;

FIG. 10 shows a schematic view of the nozzle assembly of FIG. 3 as it would operate in a drilling mode;

FIG. 11 shows a blast hole with two opposing notches for controlling fracture initiation in the direction of the notches; and FIG. 12 shows a blast hole with a plurality of notches facilitating controlled explosion and material removal.

DESCRIPTION OF PREFERRED EMBODIMENTS

Figure 1:
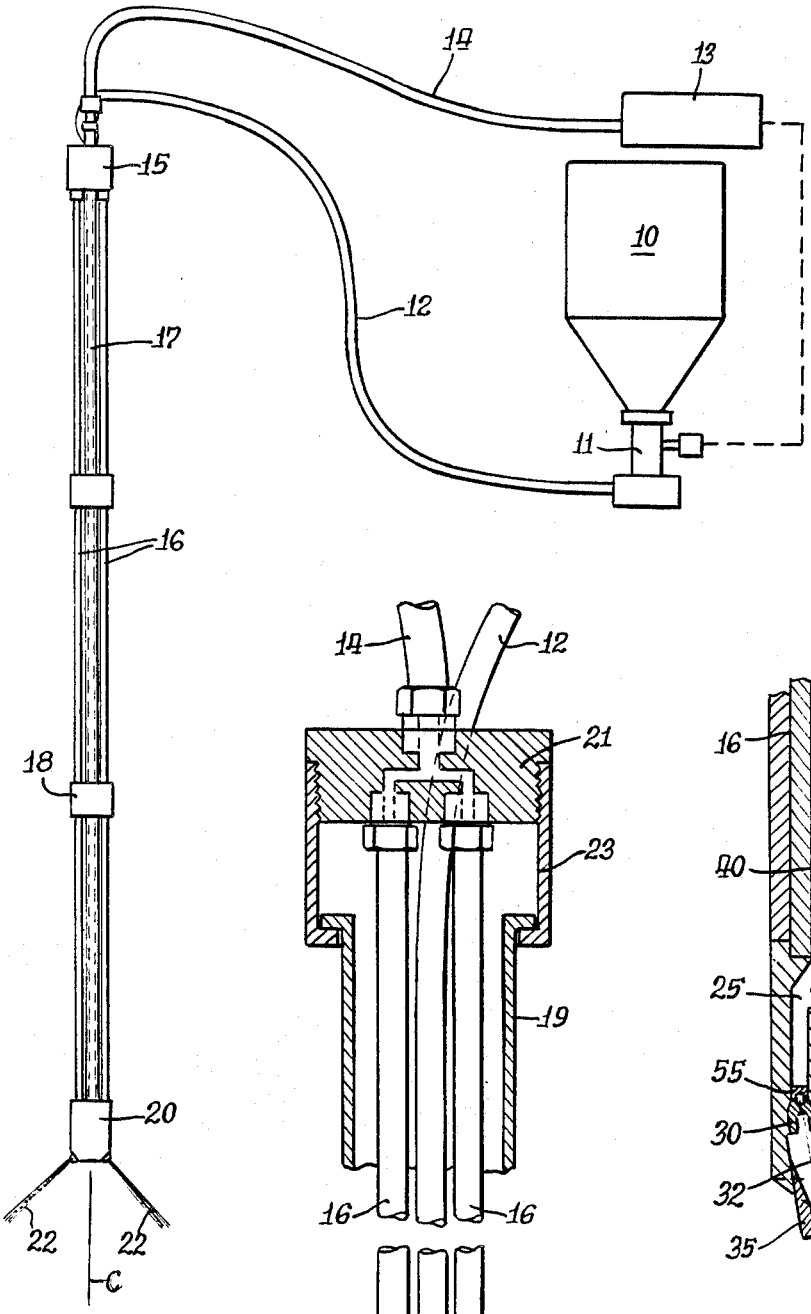
FIG. 1 shows, schematically, an apparatus of the present invention, including the particulate and fluid supply means.

As shown in FIG. 1, particulates for generating particulate containing fluid jet streams are stored in particulate tank 10, metered through flow controller 11, and conveyed through particulate hose 12 to tube/hose adapter 15. A wide range of solid particulates may be used in the process and apparatus of this invention, most suitably those having average diameters from about 2 microns to about 1200 microns, and preferably from about 10 microns to about 200 microns. Especially suitable particulates for use in this invention include abrasives such as silicon carbide, aluminum oxide, garnet, silica sand, metallic slag, glass beads, and the like.

Particulates for mixture with a fluid jet stream may be provided in a foam or a slurry form, or in a gaseous stream, as is known to the art. The transport of solid particulates in foam is advantageous since the foam containing particulates can be readily released under pressure or pumped through tubing over a long distance without settling of the particulates and with reduced wear and abrasion to the particulate tubing. Supply of particulates in a foam also permits control of the rate of particulate introduction into fluid jet streams and provides uniform distribution of particulates in the particulate supply means. In a preferred embodiment, flow controller 11 is controlled electronically, pneumatically, or hydraulically so that flow controller 11 releases particulates only when the pressurized fluid supply means is operating to provide fluid jet streams to the apparatus as indicated schematically by dashed lines in FIG. 1. Simple gravity feed arrangements are also suitable.

Fluid for generating particulate containing fluid jet streams is pressurized in high pressure pump 13 and conveyed to tube/hose adapter 15 through high pressure hose 14. The process and apparatus of this invention may be used for mixing particulates with a fluid stream of liquid or gas for any desired purpose. Water and aqueous solutions are particularly suitable fluids for use in notching blast holes. Fluid pressures of from about 100 to about 60,000 psi are desired for use in the present invention. Suitable pumps for generating pressurized fluid streams and tube and hose materials capable of withstanding fluid pressures of from about 100 to about 60,000 psi are known to the art. Particulate hose 12 and high pressure fluid hose 14 are preferably flexible, and may be provided in any length required for specific applications.

The portion of the particulate containing fluid jet apparatus including and below tube/hose adapter 15 as shown in FIG. 1, is preferably relatively rigid and may be provided with braces 18 to facilitate insertion of this portion of the apparatus into a blast hole or the like, for making notches in the blast hole. Tube/hose adapter 15 is generally situated outside the blast hole, and therefore may be larger in diameter than blast holes which are generally about 2 inches in diameter and less. Tube/-hose adapter 15 may be provided with a handle to facilitate manual insertion and removal of the apparatus from blast holes, or it may be mounted on a track to provide controlled or mechanized movement, if desired.

Figure 2:
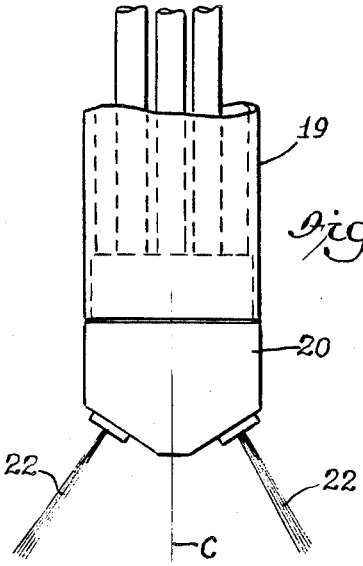
FIG. 2 shows a partially cut away, partially sectional view of a preferred arrangement for enclosing and protecting the apparatus of the present invention.

In a preferred embodiment shown in FIG. 2, the apparatus is provided with a rigid cover tube 19, rigidly connected at one end to nozzle assembly 20, such as by welding or screw engagement, and connected at its other end to fluid manifold 21 by means of cover tube collar 23. Cover tube 19 preferably comprises high strength steel or stainless steel. Fluid manifold 21 provides division of a high pressure fluid stream into two or more high pressure fluid tubes 16. Utilization of cover tube 19, fluid manifold 21 and cover tube collar 23 provides a sealed environment which is particularly advantageous when a valve means is provided to regulate the flow of particulates. Braces 18 may be provided to restrain and align fluid tubes 16 and particulate hose 17 in cover tube 19. Other types of adapters providing alignment of and securing cover tube 19 are also suitable.

Figure 3:
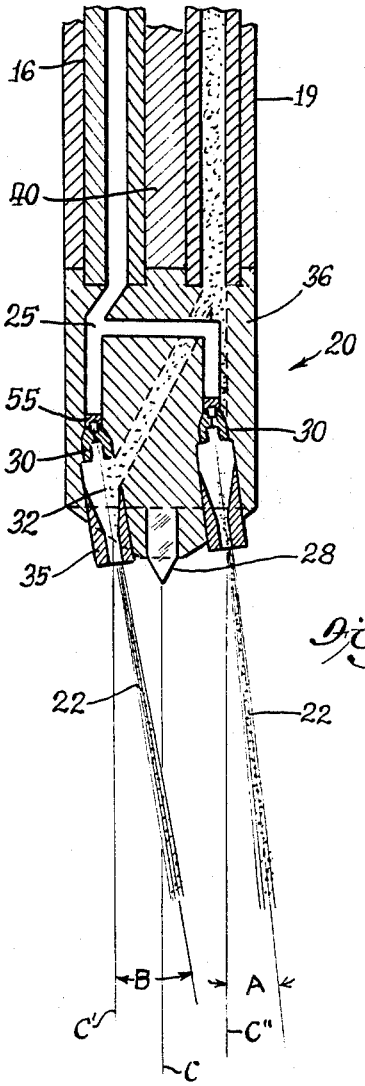
FIG. 3 shows an enlarged, partially cross-sectional view of one preferred embodiment suitable for drilling holes and/or for notching holes.

Particulates are supplied to nozzle assembly 20 through abrasive tube 17, while pressurized fluid is supplied through high pressure fluid tubes 16. In the embodiment illustrated in FIGS. 1 and 2, two high pressure fluid tubes 16 are provided to generate two discrete particulate containing fluid jet streams 22, but a single high pressure fluid tube 16 may be utilized to generate multiple particulate containing fluid jet streams as shown in FIG. 3. Diversion of high pressure fluid and particulates from a single supply tube or hose to a plurality of fluid jet nozzles 30 may be accomplished by the provision of suitable channels in nozzle body 36. The desired length of high pressure fluid tube 16, abrasive tube 17 and cover tube 19 depends upon the particular application and, frequently, upon the depth of the blast holes to be notched.

High pressure fluid streams are provided to nozzle assembly 20 separately from particulates, and nozzle assembly 20 is capable of dispersing particulates in high velocity fluid jet streams to provide high velocity particulate containing fluid jet streams. FIG. 1 illustrates an embodiment in which two discrete divergent particulate containing fluid jet streams 22 are generated, each stream issuing from nozzle assembly 20 at an angle of about 45° from central axis C of nozzle assembly 20. In operation, the rigid portion of the apparatus below tube/hose adapter 15 is inserted into a blast hole and the high pressure fluid and particulate supply means are activated to generate particulate containing fluid jet streams. Nozzle assembly 20 is traversed along the length of the blast hole, providing impingement of particulate containing fluid jet streams on the walls of the blast hole to form wedge-shaped notches. The depth and.configuration of notches is controlled by the velocity of the particulate containing fluid jet streams and the rate at which the nozzle traverses the blast hole. In general, increasing fluid pressure increases the depth of the notch produced and increases the rate at which the apparatus may be traversed along the blast hole. Multiple notches may be provided in a blast hole by a single traversal of a nozzle assembly issuing multiple particulate containing fluid jet streams, or by multiple passes of a nozzle assembly issuing one or more particulate containing fluid jet streams, with rotation of the nozzle assembly about its central axis after each pass.

FIGS. 11 and 12 illustrate blast holes with notches of the type generated by the process and apparatus of the present invention. FIG. 11 shows generally cylindrical blast hole 60 with two opposing, wedge-shaped notches, 61 and 62. Notches 61 and 62 promote fracture formation generally in the direction of the notches, and are desirably wedge-shaped with a relatively narrow taper angle. Notches 61 and 62 may be generated by a single traversal of the apparatus shown in FIG. 1 along the length of drill hole 60, or by two passes of an apparatus generating a single particulate containing fluid jet stream. FIG. 12 shows blast hole 60 with a plurality of notches 63–70 in a substantially regular radial arrangement around the perimeter of blast hole 60. A blast hole notched in this fashion is particularly useful for starting craters at the beginning of excavation, causing fracture initiation in all directions from the blast hole and removal of all surrounding material upon detonation of explosives. Notches 63–70 may be provided by an apparatus of the present invention issuing a plurality of particulate containing fluid jet streams, or by multiple passes of an apparatus issuing one or two particulate containing fluid jet streams.

One embodiment of nozzle assembly 20 for generating diverging particulate containing fluid jet streams is shown in more detail in FIG. 6. Nozzle assembly 20 shown in FIG. 6 is in fluid-tight communication with two high pressure fluid tubes 16, each having a central fluid passage **16*a*, and particulate tube 17 with central particulate passage 17*a*. Nozzle assembly 20 comprises particulate valve body 40 housing an abrasive passage valve means joined fluid-tightly to nozzle body 36 by means of at least two anchor bolts 37, only one of which is visible in FIG. 6, or other suitable connecting means. All internal passages of fluid jet nozzle assembly 20 must be capable of withstanding fluid pressures of from a few psi to about 60,000 psi. High pressure fluid tubes 16 penetrate bores provided in the base of particulate valve body 40 and are received in correspondingly aligned bores in nozzle body 36. High pressure fluid tubes 16 are securely retained in bores in nozzle body 36 by mating screw threads or other means known to the art. Tapered tube seal 24 aids in providing a fluid-tight connection between high pressure fluid tubes 16 and nozzle body 36, and provides alignment of central high pressure fluid passages 16a with fluid passages 25 through which high pressure fluid is conveyed to fluid jet nozzles 30. Fluid passages 25 are preferably substantially the same diameter as central fluid passages 16a**.

Fluid jet nozzles 30 of any type known to the art, such as taught by U.S. Pat. Nos. 4,478,368, 4,534,427, and 4,555,872, which are incorporated herein in their entirety by reference, may be adapted for use in the process and apparatus of this invention. In general, fluid jet nozzle 30 comprises orifice means 31 of high precision and smoothness. An orifice cone may be drilled to provide fluid orifices directly in fluid jet nozzle 30, or individual orifice plates may be retained in mating receptacles in an orifice support cone. Orifice means 31 generates a substantially coherent high pressure fluid jet. Orifice means 31 is preferably made from a hard material, such as hardened steel, hard ceramics, tungsten carbide, diamond, aluminum oxide, ruby or sapphire, to provide a long lifetime, and to withstand high fluid pressures. Fluid jet nozzle 30 is provided in fluid-tight communication and alignment with fluid passage 25, preferably by means of mating screw threads providing a tapered tube seal.

Coherent high velocity fluid streams issuing from fluid jet nozzle 30, as shown in FIG. 6, are substantially perpendicular with respect to one another. Arrangements of fluid jet nozzles 30 and fluid passages 25 to generate converging, diverging or parallel fluid jet streams, as known to the art, may be used with the process and apparatus of the present invention. In addition, it is known to the art to provide a single fluid jet stream issuing from a single orifice means or a plurality of fluid jet streams issuing from a single fluid jet nozzle having a plurality of orifice means. A plurality of fluid jet nozzles may also be provided in a variety of arrangements to issue convergent, divergent, parallel or spiral fluid jet streams, and any of the arrangements known to the prior art may be utilized with the process and apparatus of the present invention.

Coherent, high velocity fluid jets issuing from fluid jet nozzles 30 enter mixing chamber 32 wherein particulates issuing from at least one particulate passage in communication with central particulate passage 17a are mixed with and entrained in the high velocity fluid jet streams. Flow shaping cones 35 provide a conical section of reduced pressure in the central portion of the fluid jet to readily entrain and accelerate particulates in the fluid jet streams, producing coherent, well mixed particulate containing fluid jet streams. In the embodiment shown in FIG. 6, each fluid jet nozzle 30, with its associated fluid supply means, is in a different plane so that the high velocity fluid jets issuing from fluid jet nozzles 30 do not intercept one another in mixing chamber 32, but are slightly offset from one another.

FIGS. 7, 8 and 9 illustrate preferred embodiments wherein a plurality of particulate passages branch off from central particulate passage 17a to provide a separate mixing chamber for entrainment of particulates in conjunction with each fluid jet nozzle 30. In these embodiments, particulates are introduced peripherally to fluid jet streams.

High velocity particulate containing fluid jet streams exit nozzle body 36 through flow shaping cones 35 having tapered central passages 33 and central outlet passages 34 sized in accordance with the diameter of the particulate containing fluid jet streams. Flow shaping cones 35 may be securely retained in bores of nozzle body 36 by mating screw threads, or may be slightly loose to provide self-centering of the flow shaping cone by the high velocity fluid jet streams issuing therefrom. Flow shaping cones 35 preferably comprise very hard materials, such as tungsten carbide, silicon carbide, hard ceramics, and the like. Particulate containing fluid jet streams 22 and 23, as shown in FIG. 6, issue from nozzle body 36 at an angle of about 45° to central axis C of nozzle assembly 20. The orientation of particulate containing fluid jet streams generated by the apparatus depends upon the orientation of orifice means 31 and fluid jet nozzles 30, which may be adjusted to provide a plurality of particulate containing fluid jet streams in planes parallel to one another, diverging from central axis C at angles to about 90° and more, or converging on central axis C. For making notches in blast holes, particulate containing fluid jet streams issuing at angles of about 10° to about 90° from central axis C are preferred.

FIG. 3 shows another embodiment of the present invention in which two discrete particulate containing jets 22 are generated, and particulate containing fluid jet streams 22 issue from their respective flow shaping cones 35 at angles A and B, respectively, from axes C′ and C″, respectively, aligned parallel to central axis C of nozzle assembly 20. In the embodiment shown in FIG. 3, angle B is larger than angle A and particulate containing fluid jets 22 are thus convergent. FIG. 3 also illustrates the use and placement of discontinuity generators 55 interrupting the flow of high pressure fluid. Utilization of a discontinuity generator generally provides improved entrainment and acceleration of particulates in the fluid jet stream and uniform distribution of particulates in the particulate containing fluid jet stream over a large surface area and may be preferred for certain applications.

The discontinuity generator is positioned upstream from the orifice means and from the introduction of particulates into the fluid jet stream and it may take many forms. Any discontinuity generator means which disrupts the flow of the pressurized fluid jet or intercepts the flow of the fluid jet with a tortuous pathway, generates eddys, cavitation discontinuities, or fluid instabilities may be utilized with the process and apparatus of this invention. Discontinuity generators which have smooth surfaces and sharp, angular edges are preferred. The discontinuity generator is arranged at the downstream end of the high pressure fluid chamber and upstream from, but near the orifice means of the fluid jet nozzle. The extent of the fluid jet discontinuity and/or the size of the droplets generated can be adjusted by changing the geometry of the discontinuity generator, for example by varying the number and arrangement of sharp angular edges, and by changing the position of the discontinuity generator with respect to the orifice means inside the nozzle body. Despite the formation of discontinuities in the fluid jet stream, and the formation of fluid droplets, the velocity of the fluid jet stream may be maintained at a very high level by using orifice means of high precision and smoothness positioned properly relative to the discontinuity generator.

Figure 4:
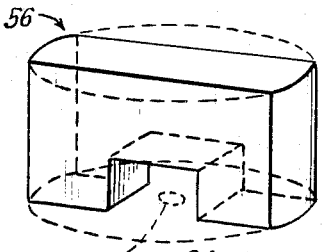
FIG. 4 shows a perspective view of one embodiment of a discontinuity generator according to the present invention.
Figure 5:
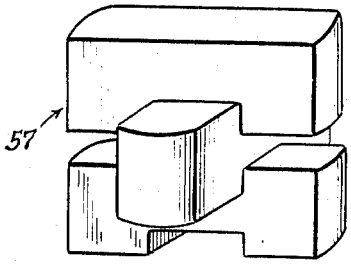
FIG. 5 shows a perspective view of another embodiment of a discontinuity generator according to the present invention.

Many different types of discontinuity generators may be utilized with the process and apparatus of this invention. For example, discontinuity generator 56 comprises a simple sharp-edged metal plate, as shown in FIG. 4, which may be machined from a cylindrical component, as shown by the dashed lines, and is provided with a cutout portion at its bottom surface adjacent the orifice means. To provide additional sharp angular edges and thereby further disrupt the fluid jet flow, two or more plates may be stacked on top of one another in different orientations, to provide discontinuity generator 57, as shown in FIG. 5. The plates may be stacked on top of each other, or may be provided with mating cutouts so that each individual plate meshes with the adjacent plate or plates. A discontinuity generator may also be provided in the form of a retaining bolt and washer having sharp edges, the retaining bolt additionally serving to fasten the orifice plate or plates in recesses of the orifice cone. For most applications, it is preferred that the sharp, angular edges of the discontinuity generator form right angles. In general, the more angular sharp-edged surfaces, the greater is the disturbance of the fluid jet stream. For different applications, characteristics of the high velocity particulate containing fluid jet, such as intensity, effective surface area of application, etc., may be readily and conveniently modified.

Nozzle assembly 20 also comprises a particulate passage valve means provided in particulate valve body 40 for closing and sealing particulate tube 17 to prevent the flow of particulates into mixing chamber 32 when the fluid jet apparatus is not in operation, and to prevent leakage of fluid into particulate tube 17. During operation of the fluid jet apparatus, the high pressure fluid streams generate strong suction inside the fluid jet cavities, thus preventing leakage of fluid into the particulate passage, regardless of the orientation of nozzle assembly 20. When the high pressure fluid supply is inactivated, however, residual fluid is likely to leak into the particulate passage, and may cause caking of particulates and interruption of particulate supply. FIGS. 7 and 8 show a preferred valve means in detail, FIG. 7 showing the valve means in closed condition sealing particulate tube 17, and FIG. 8 showing the valve means in open condition allowing the free flow of particulates to mixing chamber 32. Particulate tube 17 is preferably flexible, elastic, and resistant to abrasion. Suitable materials, such as flexible synthetic tubing, natural rubber tubing, neoprene rubber tubing and the like, are known to the art. Particulate hose 17 may be conveniently removed and replaced if it becomes worn.

The particulate valve means shown in FIGS. 7 and 8 comprises particulate valve body 40 having a bore through which particulate hose 17 passes, and a valve means assembly comprising valve piston spring housing 41, valve piston spring 42, valve piston 45, valve ball 43, and valve plunger 50, provided in passages of particulate valve body 40 adjacent particulate hose 17. The valve means shown in FIGS. 7 and 8, which is preferred for use in the present invention, is operated by fluid pressure. The valve means closes and opens particulate hose 17 in response to the presence or absence of pressurized fluid in fluid passage 25. Valve means fluid passage 26 is in direct communication with fluid passage 25. Valve means fluid passage plug 27 may be provided to prevent the escape of pressurized fluid.

Valve plunger 50 is freely slidably retained in valve plunger cavity 49, and is in contact with valve piston 45 or is fixedly attached to valve piston 45. Valve piston 45 is preferably generally cylindrical, and is provided with valve piston recess 46 which conforms generally to the configuration of valve ball 43 in its central portion and has smooth, diverging peripheral portions to facilitate transfer of valve ball 43 into and out from valve piston recess 46. Valve piston 45 is also freely slidable, and is adjacent and contacting valve piston spring 42 in valve piston spring housing 41 at its end remote from valve plunger 50. The internal wall of particulate valve body 40 separating the valve means from particulate tube 17 is provided with valve ball passage 44 which is preferably slightly larger than the diameter of valve ball 43 to allow passage of valve ball 43 therethrough. The components of the particulate valve means are preferably of high precision and smoothness and preferably comprise non-corrosive, hard materials such as stainless steel and the like.

As shown in FIG. 7, when the apparatus is not in operation and the pressurized fluid supply has been inactivated, valve piston spring 42 forces valve piston 45 and valve plunger 50 downwardly until valve piston 45 abuts the upper surface of nozzle body 36, and valve ball 43 is forced out of valve piston recess 46 and through valve ball passage 44 to constrict particulate tube 17 and prevent the flow of particulates therethrough. Valve ball 43 is retained in this closing and sealing condition by the side wall of valve piston 45. In this position, as shown in FIG. 7, the flow of particulates through particulate tube 17 is arrested, and likewise, leakage of any fluid into particulate tube 17 is prevented.

When the high pressure fluid supply has been activated, as shown in FIG. 8, high pressure fluid flows into valve means fluid passage 26 and valve plunger cavity 49, and the force of the pressurized fluid causes the upward displacement of valve plunger 50 and valve piston 45, and compression of valve piston spring 42. As valve plunger 50 is displaced, valve piston recess 46 is displaced adjacent valve ball 43, and valve ball 43 traverses valve ball passage 44, due to the elasticity of and internal pressure upon particulate tube 17, and is retained in valve piston recess 46, thereby opening particulate tube 17 and allowing the free flow of particulates into mixing chamber 32. Thus, by a simple mechanical valve means, the flow of particulates is automatically interrupted when the pressurized fluid supply means is inactivated, and particulate supply is provided as soon as the pressurized fluid supply means is activated. The size of valve ball 43, the diameter of valve piston 45, the size and shape of valve piston recess 46, the diameter and wall thickness of particulate tube 17, the strength and length of valve piston spring 42, the length and diameter of valve plunger 50, and the pressure of fluid supplied to the apparatus are interrelated and must be coordinated to provide an effective and reliable particulate valve means.

As shown in FIGS. 7 and 8, gasket 38 is preferably provided between particulate valve body 40 and nozzle body 36 to provide a fluid-tight seal. In addition, fluid-tight seal 48 is preferably provided to prevent pressurized fluid from leaking into the valve means, and bushing 47 may be provided to facilitate sliding of valve plunger 50 and to prevent leakage of pressurized fluid.

FIG. 9 shows another embodiment utilizing a simple mechanical valve means comprising valve ball 43, valve piston 45 with valve piston recess 46 and valve piston spring 42 in valve piston spring housing 41, but in this embodiment the valve means is operated manually or automatically by valve stem 51 penetrating housing 41 in an area provided with stem seal 52. The valve means is in a closed condition at rest due to the force of valve piston spring 42 which displaces valve piston 45 downwardly to force valve ball 43 against particulate tube 17, as shown in FIG. 7. When valve stem 51 is pulled, valve piston spring 42 is compressed, and the particulate supply means is in open condition to provide free flow of particulates. This embodiment is preferred for use in certain applications where the particulate passage may serve additional purposes. For example, during notching of vertical blast holes extending downwardly, it may become necessary to remove fluid, debris, and spent particulates from the drill hole. For this purpose, the particulate hose may be detached from the particulate supply means and connected to a vacuum means to provide suction for removing materials from the blast hole.

The blast hole notching apparatus of this invention may be provided in the form of a hand-held, portable device; it may be incorporated in other equipment such as a rock drill; or it may be provided in a fully mechanized unit integrated into a rock drill, or other drilling apparatus.

FIGS. 3 and 10 illustrate an embodiment of the present invention which is suitable for drilling holes in hard materials, such as rock. Drill tip 28 is provided at the lower end of nozzle body 36 and aligned with central axis C. Drill tip 28 may comprise tungsten carbide, hard ceramics, or other hard materials which are known to the art. Arrangement of fluid jet nozzles 30 and flow shaping cones 35 to generate particulate containing fluid jet streams 22 in substantially the same direction is important in this embodiment. Angles A and B between particulate containing fluid jet streams 22 and their respective axes C′ and C″ are preferably about 5° to about 45°, and may be adjusted to provide fluid jet streams which are parallel, convergent or divergent with respect to each other. More than two particulate containing fluid jet streams 22 may issue from more than two fluid jet nozzles 30. According to this embodiment, at least one fluid jet stream 22 intersects central axis C of nozzle body 36 and at least one fluid jet stream 22 scribes an outer circular groove having a diameter greater than the diameter of nozzle assembly 20. These two conditions are satisfied by adjustment of angles A and B in accordance with the orientation of fluid jet streams 22 and nozzle assembly 20. Upon rotation of this apparatus, holes may be drilled in hard materials such as rock, as shown in FIG. 10. Cutting edges 39 may also be provided on a lower conical portion of nozzle body 36 to facilitate drilling operations. According to the embodiment shown in FIG. 10, one particulate containing fluid jet stream makes an inner conical cut in the rock, while the other particulate containing fluid jet stream makes an angled outer circular groove. Once the inner rock cone has been separated and removed, cutting edges 39 facilitate removal of the ridges and the drill hole is extended to the angled circular groove. For drilling holes of a relatively small diameter in rock, the embodiment described herein issuing two particulate containing fluid jet streams and having two cutting edges 39 is sufficient. For drilling larger holes in rock, a preferred embodiment provides more than two particulate containing fluid jet streams and more than two cutting edges 39 to accelerate removal of ridges formed by the particulate containing fluid jet streams. The result of continued rock drilling operation utilizing this embodiment of the invention will be a cylindrical hole having a diameter larger than the diameter of the drilling apparatus with a spirally serrated wall. Utilization of discontinuity generators as shown in FIGS. 4 and 5 is especially preferred in this embodiment since discontinuity generators provide a broader fluid jet stream to cut a wider groove. This embodiment may also utilize an integrated nozzle cutting head provided on the lower end of nozzle body 36 which accommodates recessed or flush flow shaping cones 35 and provides an expanded drilling surface.

Hard materials, such as rock having a compressive strength in excess of 20,000 psi can be notched to a considerable depth utilizing moderate fluid pressures of about 10,000 psi, which may be supplied by available crankshaft pumps, according to the process and apparatus of the present invention. Increasing the fluid pressure supplied to the apparatus generally increases the depth of the notches as well as the speed of notching, and provides reduced fluid consumption, reduced fluid thrust force at the nozzle, and reduced fluid pressure drop inside the high pressure fluid tube, without increasing the pump power input or abrasive consumption rate. It is, therefore, desirable to maintain fluid pressure at the highest level allowed by the equipment utilized.

The particulate supply valve means described in detail and shown in FIGS. 6–9 may be provided in other forms as well. Other types of valves as may be known to the art may be used to accomplish the purposes of this invention. The valve ball may be replaced by a plunger, or the like, or the valve means may be provided at a different location along the particulate supply means. For example, a valve means may be provided in the nozzle body to open and close a particulate passage drilled in the nozzle body.

While the preferred application of the process and apparatus of this invention has been described with respect to notching blast holes in very hard materials such as concrete and rock, it is readily apparent that the process and apparatus of this invention is advantageously applicable to all fluid streams containing a mixture of solid particulates. While the fluid streams have been described as liquid streams, such as water, it is readily apparent that fluid streams such as air or other gaseous fluids may be readily used. The most advantageous distance from the fluid-solid mixing nozzle to the material desired to be cut or cleaned can be readily ascertained by one using the method and apparatus of this invention.

The following examples setting forth specific materials, quantities, sizes, and the like are for the purpose of more fully understanding very specific embodiments of the invention and are not meant to limit the invention in any way.

EXAMPLE I

A nozzle assembly of the general type shown in FIG. 6 was constructed, utilizing a single high pressure fluid tube and issuing a single fluid jet. The nozzle assembly was connected to high pressure fluid supply means and a high velocity water jet was generated without introducing any particulates. The cutting ability of the high velocity water jet was tested on a hard rock specimen comprising Canadian Massive Rhyolite having an average uniaxial compressive strength in excess of 20,000 psi. A pump means having a power input of 11 hp was used to generate a water jet at pressures in excess of 30,000 psi. Impingement of this water jet on the hard rock specimen at close range hardly scratched the rock surface and removed only loose surface particles.

The above described apparatus was then used to generate particulate containing water jets. Idaho garnet sand of grit size #60, having an average particle size of about 400 was introduced into the nozzle assembly at a feed rate of about 0.5 lb/min to generate a particulate containing water jet. For each test, the rock specimen was traversed at a rate of about 6 inches/min, and the distance between the nozzle assembly and the rock specimen was about ¼ to ½ inch. Using a fluid pressure of 10,000 psi and a fluid jet nozzle having an orifice means about 0.025 inch in diameter, the particulate containing water jet cut a narrow slot to a depth of about 0.62 inch in the hard rock specimen. Using a fluid pressure of 20,000 psi and a fluid jet nozzle having an orifice means about 0.015 inch in diameter, the particulate containing water jet cut a narrow slot to a depth of about 0.84 inch in the hard rock specimen. Using a fluid pressure of about 30,000 psi and a fluid jet nozzle having an orifice means about 0.011 inch in diameter, the particulate containing water jet cut a narrow slot to a depth of about 1.10 inch in the same hard rock specimen. This cut was about 0.15 inch wide at the rock surface and was wedge-shaped. This series of tests demonstrates that a particulate containing water jet is well suited to making notches in blast holes and that higher fluid pressures produce relatively deeper notches, and are therefore preferred for many applications.

EXAMPLE II

A particulate passage valve means substantially as shown in FIGS. 7 and 8 was constructed to open and close a particulate hose comprising rubber tubing having a diameter of 7/16 inch. The valve ball and the valve piston had diameters of ⅜ inch. Without providing a valve piston spring, a force of about 15 pounds was required to displace the valve piston downwardly, forcing the valve ball through the valve ball passage to close and seal the particulate hose. A bias spring about 1.8 inch long was then provided in the valve spring housing, and the spring maintained the particulate hose in the sealed condition. Tap water at a pressure of about 50 psi did not penetrate the particulate passage. A force of about 80 pounds would, however, cause compression of the valve piston spring, and displacement of the particulate valve means to an open condition allowing free passage of particulates. The 80 pound force required to actuate the valve means and open the particulate hose may be provided by fluid pressure of about 10,000 psi contacting a valve plunger having a diameter of about ⅛ inch fixedly attached to the valve piston. Thus, when the pressurized fluid supply means is activated to provide fluid at a pressure of about 10,000 psi, the valve means is displaced from the closed to the open condition and the particulate passage is opened to provide flow of particulates.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein may be varied considerably without departing from the basic principles of the invention.

I claim:

1. An apparatus for generating at least one particulate containing fluid jet stream comprising:

a pressurized fluid supply means connected to at least one pressurized fluid supply conduit;

a particulate supply means connected to at least one particulate supply conduit;

a nozzle assembly fluid-tightly joined to said pressurized fluid supply conduit and said particulate supply conduit, said nozzle assembly comprising at least one fluid jet nozzle means having at least one orifice means in communication with said pressurized fluid supply means; at least one mixing chamber wherein particulates are mixed with and entrained in at least one fluid stream aligned with said orifice means and in communication with said particulate supply means; and a particulate valve body housing a particulate valve means capable of closing and opening a flexible portion of said particulate supply conduit, said particulate valve means is adjacent said flexible portion of said particulate supply conduit and comprises a valve piston having a side recess facing said conduit, a valve ball retainable in said side recess opening said flexible portion of said particulate supply conduit and closing said conduit when said piston is moved to a position said ball is not retained in said recess moving said ball through a valve ball passage provided in said particulate valve body housing to close said flexible portion of said particulate tube, a valve piston spring providing a force against a first end of said valve piston, and a valve stem means fixedly attached to said first end of said valve piston, said valve stem means extending external to said valve means providing opening and closing of said particulate valve means external to said nozzle assembly.

2. In an apparatus of the type comprising a pressurized fluid supply means connected to at least one fluid supply conduit, a particulate supply means connected to at least one particulate supply conduit; a nozzle assembly joined to said pressurized fluid supply conduit and separately joined to said particulate supply conduit and capable of generating at least one particulate containing fluid jet stream, the improvement comprising: a particulate valve means within said nozzle assembly which automatically closes a flexible wall particulate supply conduit when said pressurized fluid supply means is inactivated and automatically opens said flexible wall particulate supply conduit when said pressurized fluid supply means is activated, said particulate valve means comprising a valve piston movable within a cylinder substantially parallel to said flexible wall particulate supply conduit within said nozzle assembly and having a side recess facing said flexible wall particulate supply conduit; a valve ball sized to fit adjacent said piston away from said side recess forcing said flexible particulate supply conduit closed when said valve piston is moved to a first position by force of a bias spring force against a first end of said piston, and sized to fit within said piston side recess when said valve piston is moved to a second position by force against an opposite second end of said piston caused by said pressurized fluid thereby opening said flexible particulate supply conduit for supply of particulates to said particulate containing fluid jet stream, said pressurized fluid force caused by passage of said pressurized fluid from said fluid supply conduit through fluid passage means within said nozzle assembly.

3. In an apparatus according to claim 2, wherein said valve piston is moved to said second position when said force of said pressurized fluid exceeds said force of said force of said bias spring.

4. In an apparatus according to claim 3, wherein a valve plunger extends from said second end of said piston slidably through a valve plunger cavity, said pressurized fluid providing a force against the end of said valve plunger thereby applying force against said second end of said piston.

5. In an apparatus according to claim 2, wherein a valve plunger extends from said second end of said piston slidably through a valve plunger cavity, said pressurized fluid providing a force against the end of said valve plunger thereby applying force against said second end of said piston.

6. In an apparatus according to claim 2, wherein said recess has smooth diverging peripheral portions to facilitate movement of said valve ball into and out from said recess.

7. In an apparatus according to claim 2, wherein a valve stem extends from said first end of said valve piston to the exterior of said nozzle assembly providing manual operation of said particulate valve means.

8. In an apparatus according to claim 2 additionally comprising at least one flow shaping cone aligned with said at least one orifice means, each said flow shaping cone having a central passage for issuing a particulate containing fluid jet stream.

9. In an apparatus according to claim 2 comprising of two said fluid jet nozzle means, each said fluid jet nozzle means having a centrally arranged orifice means, wherein said nozzle means are oriented substantially opposite one another and said orifice means are oriented to generate diverging fluid streams at an angle of about 30° to about 90° from a central axis of said nozzle assembly.

10. An apparatus according to claim 9 wherein said nozzle means are oriented in different planes offset slightly from one another.

11. In an apparatus according to claim 2 wherein said pressurized fluid conduit and said particulate supply conduit are flexible hoses and said apparatus additionally comprises a tube/hose adapter attached to said pressurized fluid conduit and said particulate supply conduit, at least one particulate tube and at least one rigid high pressure fluid tube fluid-tightly attached at one end to said tube/hose adapter and at the other end to said nozzle assembly for conveying particulates and fluid streams, respectively, from said supply means to said nozzle assembly.

12. An apparatus according to claim 11 wherein said at least one particulate tube and said at least one rigid high pressure fluid tube are enclosed by a rigid cover tube attached at one end to said tube/hose adapter and at the other end to said nozzle assembly.

13. An apparatus according to claim 11 wherein said tube/hose adapter comprises a high pressure fluid manifold diverting high pressure fluid from said pressurized fluid conduit into at least two said high pressure fluid tubes.

14. In an apparatus according to claim 2 wherein said particulate supply means comprises a flow controller to regulate the flow of particulates therefrom and said flow controller is in communication with said pressurized fluid supply means and releases particulates only when said pressurized fluid supply means is activated.

15. In an apparatus according to claim 2 wherein said nozzle assembly is provided with a plurality of particulate passages diverging from said particulate supply means and each said particulate passage terminates in a mixing chamber aligned with at least one fluid jet nozzle means.

16. In an apparatus according to claim 2 comprising a plurality of fluid jet nozzle means.

17. In an apparatus according to claim 2 additionally comprising a discontinuity generator means provided in proximity to each said fluid jet nozzle means.

18. In a process of the type comprising supplying a pressurized fluid through at least one fluid supply conduit and particulates through at least one particulate supply conduit to a nozzle assembly joined to said pressurized fluid supply conduit and separately joined to said particulate supply conduit and capable of generating at least one particulate containing fluid jet stream, the improvement comprising: passing said particulates through a particulate valve means within said nozzle assembly which automatically closes a flexible wall particulate supply conduit when said pressurized fluid supply means is in activated and automatically opens said flexible wall particulate supply conduit when said pressurized fluid supply means is activated, said particulate valve means comprising a valve piston movable within a cylinder substantially parallel to said flexible wall particulate supply conduit within said nozzle assembly and having a side recess facing said flexible wall particulate supply conduit; a valve ball sized to fit adjacent said piston away from said side recess forcing said flexible particulate supply conduit closed when said valve piston is moved to a first position by force of a bias spring force against a first end of said piston, and sized to fit within said piston side recess when said valve piston is moved to a second position by force against an opposite second end of said piston caused by said pressurized fluid thereby opening said flexible particulate supply conduit for supply of particulates to said particulate containing fluid jet stream, said pressurized fluid force caused by passage of said pressurized fluid from said fluid supply conduit through fluid passage means within said nozzle assembly.

* * * * *